US012515905B2

(12) United States Patent
Emoto et al.

(10) Patent No.: US 12,515,905 B2
(45) Date of Patent: Jan. 6, 2026

(54) APPARATUS AND CONVEYANCE METHOD

(71) Applicant: CANON KABUSHIKI KAISHA, Tokyo (JP)

(72) Inventors: Yuki Emoto, Tokyo (JP); Takashi Sasaki, Kanagawa (JP); Shuichi Tokuda, Kanagawa (JP); Koki Kudo, Kanagawa (JP); Hideyasu Ishihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 18/472,116

(22) Filed: Sep. 21, 2023

(65) Prior Publication Data

US 2024/0101379 A1 Mar. 28, 2024

(30) Foreign Application Priority Data

Sep. 26, 2022 (JP) ..... 2022-152805

(51) Int. Cl.
*B65H 7/14* (2006.01)
*B65H 9/00* (2006.01)

(52) U.S. Cl.
CPC ..... *B65H 9/002* (2013.01); *B65H 7/14* (2013.01); *B65H 2301/331* (2013.01); *B65H 2511/13* (2013.01)

(58) Field of Classification Search
CPC .... B65H 9/002; B65H 7/14; B65H 2301/331; B65H 2511/13
See application file for complete search history.

(56) References Cited

U.S. PATENT DOCUMENTS

2019/0030934 A1* 1/2019 Arakane ..... B41J 2/17546

FOREIGN PATENT DOCUMENTS

| | | | | |
|---|---|---|---|---|
| JP | 2000109243 A | | 4/2000 | |
| JP | 2005212101 A | * | 8/2005 | ..... B41J 19/18 |
| JP | 2009262413 A | * | 11/2009 | ..... B41J 2/01 |
| JP | 2018193200 A | * | 12/2018 | ..... B65H 9/14 |

* cited by examiner

*Primary Examiner* — Yaovi M Ameh

(74) *Attorney, Agent, or Firm* — Canon U.S.A., Inc. IP Division

(57) ABSTRACT

An apparatus comprising a conveyance roller configured to convey a print medium, a print unit configured to execute printing on the print medium, a platen arranged to face the print unit and configured to support the print medium, a sensor configured to emit light to the platen and detect light from the platen, and a control unit configured to execute first control of acquiring, as a first value, a detected value before the print medium reaches a light irradiation region of the sensor, and acquiring, as a second value, a detected value after the print medium is conveyed to include the light irradiation region, wherein the control unit further execute second control of correcting a conveyance amount of the print medium by the conveyance roller based on the first value and the second value.

18 Claims, 9 Drawing Sheets

APPARATUS AND CONVEYANCE METHOD

BACKGROUND

Technical Field

The aspect of the embodiments relates to a conveyance method of a print medium.

Description of the Related Art

Some of printing apparatuses represented by an inkjet printer convey a print medium such as a cut sheet and detect the position of the print medium by an optical sensor (see Japanese Patent Laid-Open No. 2000-109243).

As a print medium to be conveyed, various types of print media of various materials, colors, surface properties, thicknesses, and the like can be used. Therefore, detection of the position of a print medium by the optical sensor may vary due to the characteristics of the print medium, and there is room for improvement of the accuracy of conveyance of the print medium.

SUMMARY

One of aspects of the embodiments provides an apparatus comprising a conveyance roller configured to convey a print medium, a print unit configured to execute printing on the print medium, a platen arranged to face the print unit and configured to support the print medium, a sensor configured to emit light to the platen and detect light from the platen, and a control unit configured to execute first control of acquiring, as a first value, a detected value before the print medium reaches a light irradiation region of the sensor, and acquiring, as a second value, a detected value after the print medium is conveyed to include the light irradiation region, wherein the control unit further execute second control of correcting a conveyance amount of the print medium by the conveyance roller based on the first value and the second value.

Further features of the disclosure will become apparent from the following description of exemplary embodiments (with reference to the attached drawings).

DESCRIPTION OF THE EMBODIMENTS

Figure 1:
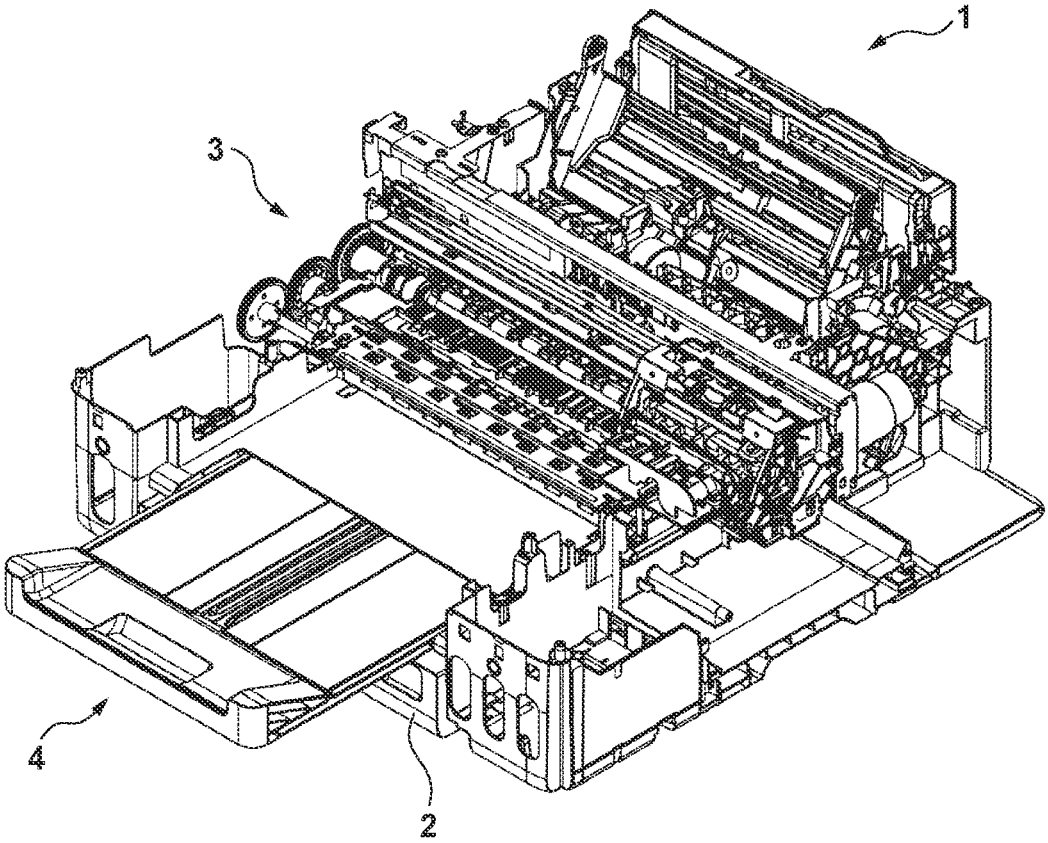
FIG. 1 is a perspective view of a printing apparatus according to an embodiment.

Embodiments will be described in detail below with reference to the accompanying drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

FIG. 1 is a perspective view of an inkjet printing apparatus 1 according to an embodiment (FIG. 1 does not illustrate part of the housing of the printing apparatus 1 for the sake of a description of an internal structure). The printing apparatus 1 includes a paper feed cassette 2, a print unit 3, and a discharge unit 4. One or more sheets (not shown) are stacked on the paper feed cassette 2, and fed one by one from the paper feed cassette 2 into the printing apparatus 1, and the print unit 3 executes printing on the sheet. The print unit 3 discharges the printed sheet to the discharge unit 4. Note that the sheet is typically a cut sheet obtained by cutting a paper material in a predetermined size but may be another print medium.

Figure 2:
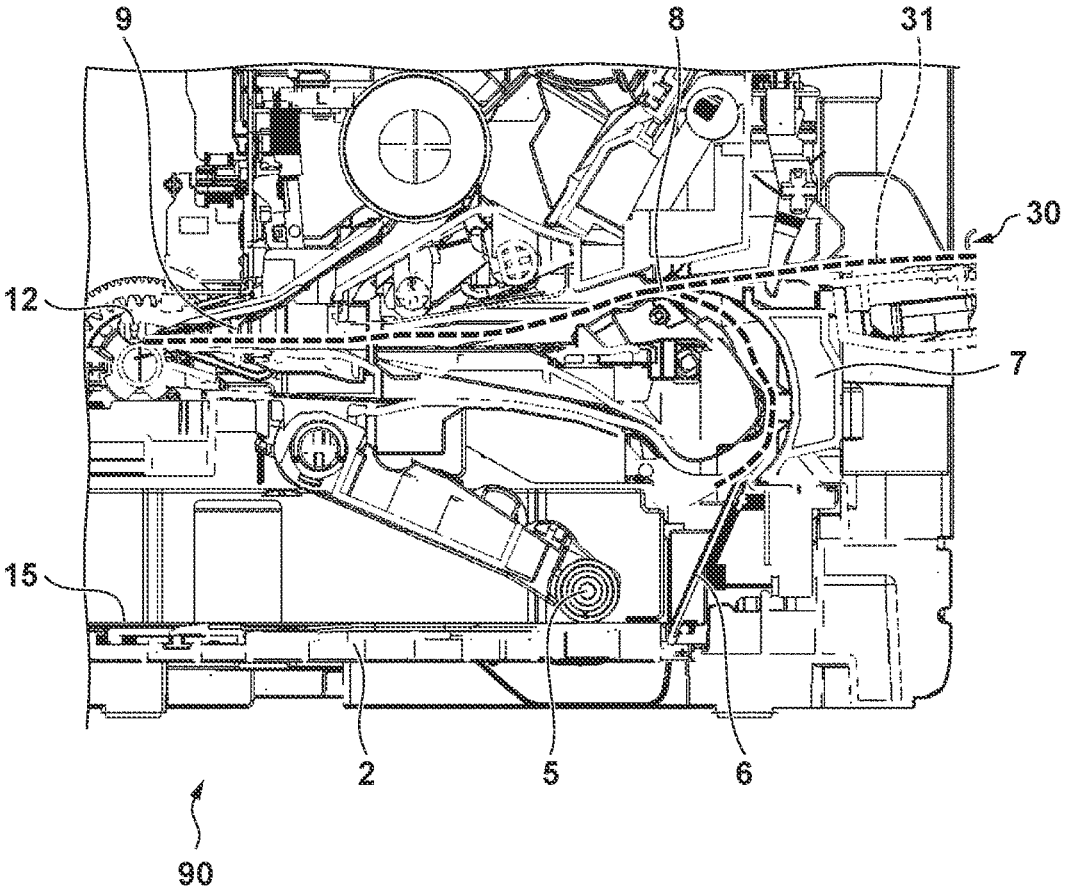
FIG. 2 is a sectional view of a paper feed mechanism of the printing apparatus.

FIG. 2 is a sectional view of a paper feed mechanism 90 as a structure portion from the paper feed cassette 2 to the print unit 3 when viewed from a side of the printing apparatus 1. Note that in the following description, with respect to the relative positional relationship among two or more elements in a feeding or conveyance direction of a sheet, the paper feed side can be represented as an upstream side and the discharge side can be represented as a downstream side. The paper feed mechanism 90 includes a paper feed roller 5, a separating slope 6, a rear guide 7, a conveyance roller (or a conveyance roller pair) 8, and an edge sensor 9.

The paper feed roller 5 is provided to be able to abut against a sheet S stacked on the paper feed cassette 2, and feeds the sheet by rotating while abutting against the sheet S. The separating slope 6 is provided on the downstream side of the paper feed roller 5, and each fed sheet S abuts against the separating slope 6 to be separately fed, and is guided in a predetermined direction by a conveyance guide such as the rear guide 7. The conveyance roller 8 is arranged in a conveyance path from the paper feed roller 5 to the print unit 3, and the sheet fed from the paper feed cassette 2 is conveyed by the conveyance roller 8 when entering the conveyance roller 8.

The edge sensor 9 is arranged on the downstream side of the conveyance roller 8, and acquires the position information of the sheet S by detecting the leading edge of the fed sheet S. The print unit 3 is provided with a main conveyance roller (or a main conveyance roller pair) 12 (to be described later). The sheet S is conveyed to the main conveyance roller 12, and the edge sensor 9 can acquire the position information of the sheet S during the conveyance.

In this embodiment, the paper feed mechanism 90 further includes a rear paper feed port 30 and a rear paper feed path 31. The rear paper feed port 30 is provided on the rear surface of the main body of the printing apparatus 1, and the sheet S inserted into the rear paper feed port 30 can be received by the main body of the printing apparatus 1 via the rear paper feed path 31, fed to the main conveyance roller 12 by the conveyance roller 8, and then printed by the print unit 3. In this example, the conveyance path from the rear paper feed path 31 to the main conveyance roller 12 is substantially, linearly extended on a side view (when viewed from a side of the printing apparatus 1) or is formed in one direction so that the curvature is equal to or smaller than a reference value or not to include a curve. This can feed the sheet S to the main conveyance roller 12 without bending it, and can execute printing on, for example, the relatively thick sheet S.

Figure 3:
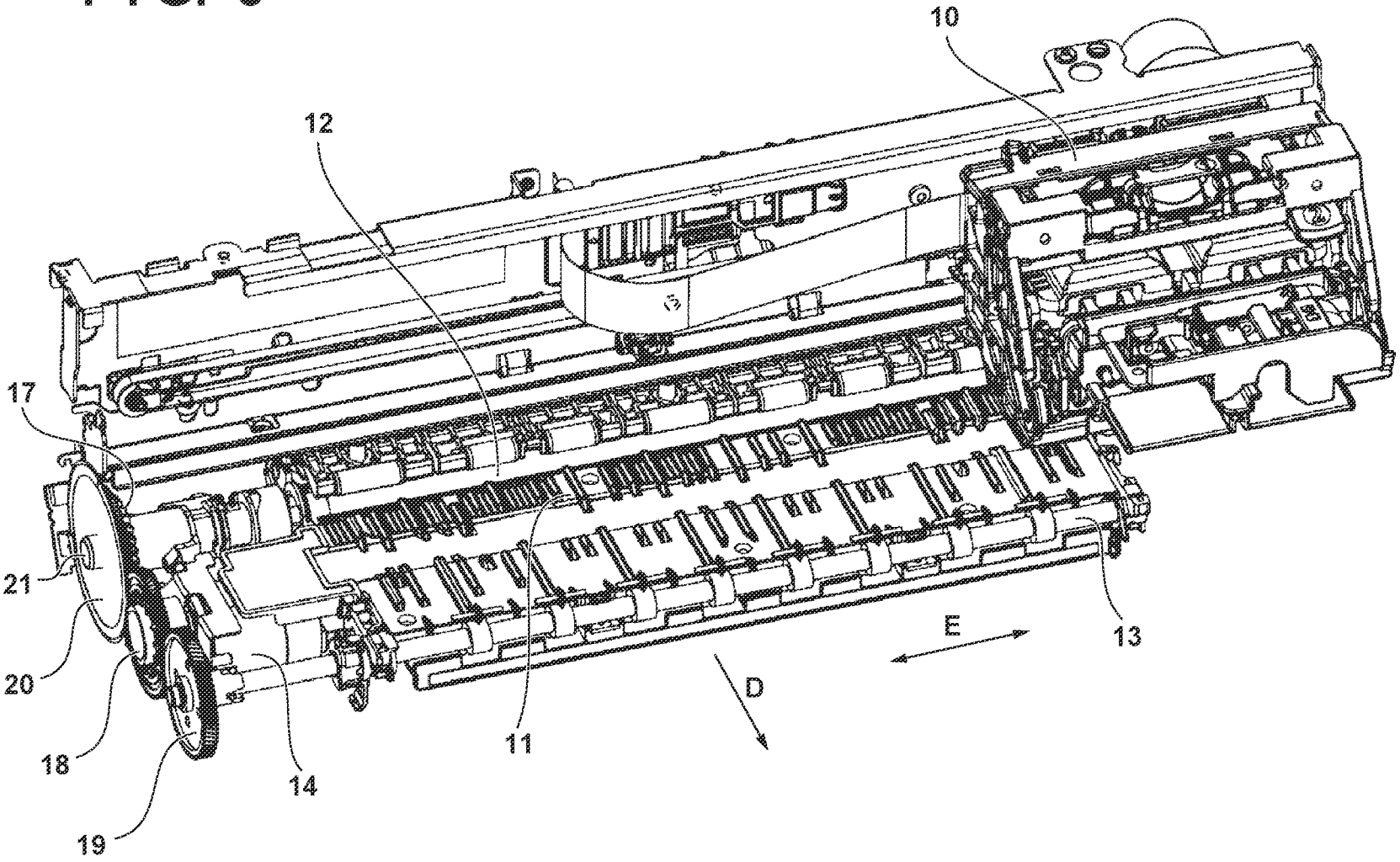
FIG. 3 is a perspective view of a print unit.

FIG. 3 is a perspective view of the print unit 3. The print unit 3 includes a carriage 10, a platen 11, the main conveyance roller 12, and a discharge roller (or a discharge roller pair) 13. The carriage 10 is detachably mounted with a printhead (not shown), and can scan the mounted printhead in a predetermined direction. The platen 11 is a support portion that supports the sheet S and is arranged at a position facing the carriage 10. The discharge roller 13 conveys the sheet S printed by the printhead to the discharge unit 4.

In FIG. 3, the conveyance direction of the sheet S is indicated by a direction D, the scanning direction of the carriage 10 is indicated by a direction E, and the directions D and E intersect each other (are substantially orthogonal to each other). The direction D can also be represented as a sheet length direction or simply a length direction, and the direction E can also be represented as a sheet width direction or simply a width direction.

The sheet S is conveyed in the direction D by the main conveyance roller 12 and the discharge roller 13 while being supported from below by the platen 11. During the conveyance, the carriage 10 moves in the direction E and the printhead mounted on the carriage 10 discharges ink, thereby executing printing on the sheet S.

The main conveyance roller 12 rotates when the power of a DC motor as a conveyance motor 14 is transmitted to a main conveyance roller gear 17 on the shaft of the main conveyance roller 12 via a driving transmission arrangement (not shown). A code wheel 20 in which slits are formed at a predetermined pitch is coaxially, directly connected to the main conveyance roller 12. An encoder sensor 21 is installed for the code wheel 20, and reads the timing or the number of times of passage of the slit on the code wheel 20. The discharge roller 13 rotates when power is transmitted from the main conveyance roller gear 17 to a discharge roller gear 19 via an idler gear 18. In the printing apparatus 1, the rotation amounts of the main conveyance roller 12 and the discharge roller 13 are commonly managed using the encoder sensor 21, thereby implementing appropriate conveyance of the sheet S.

Figure 4:
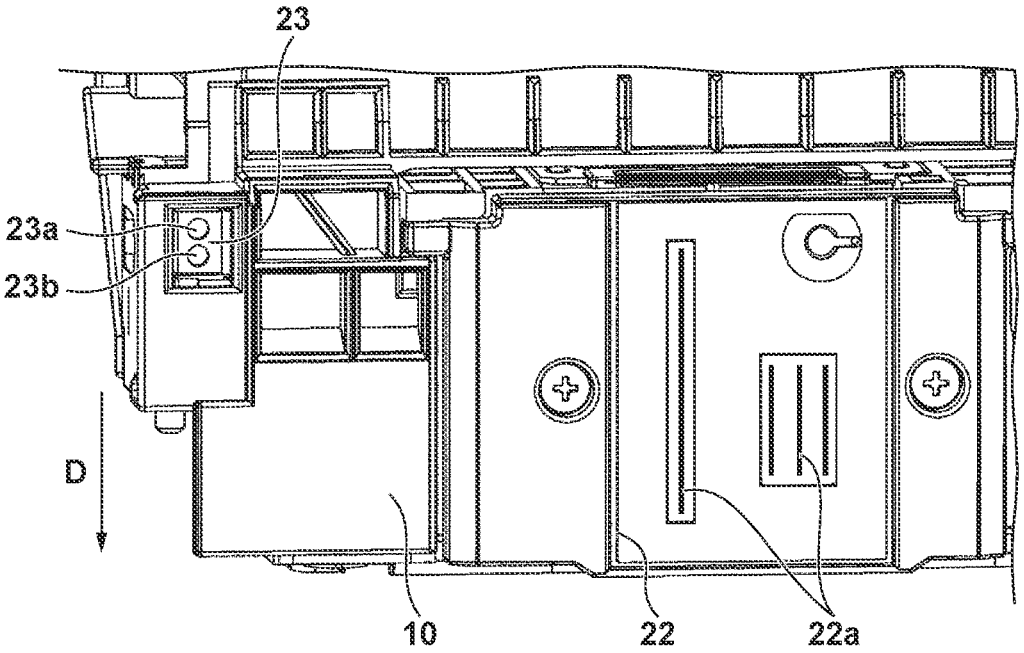
FIG. 4 is a perspective view of a carriage.

FIG. 4 is a perspective view of the carriage 10 when viewed from below. In this example, a printhead 22 is mounted on the carriage 10, and can discharge inks from nozzles 22*a*. An optical sensor 23 is installed in the carriage 10. Assume that the optical sensor 23 is a reflection type optical sensor that includes a light emitting unit 23*a* and a light receiving unit 23*b*, and detects the presence/absence of the sheet S by irradiating the surface of the sheet S with light from the light emitting unit 23*a* and detecting reflected light from the surface by the light receiving unit 23*b*. For example, a light emitting diode (LED) can be used as the light emitting unit 23*a* and a photo transistor (or photodiode) can be used as the light receiving unit 23*b*.

By installing the optical sensor 23 in the carriage 10, it is possible to detect the sheet S near the printhead 22 that discharges ink to the sheet S. The optical sensor 23 is arranged to be located on the upstream side of the printhead 22 or the nozzles 22*a* in the conveyance direction.

Figure 5:
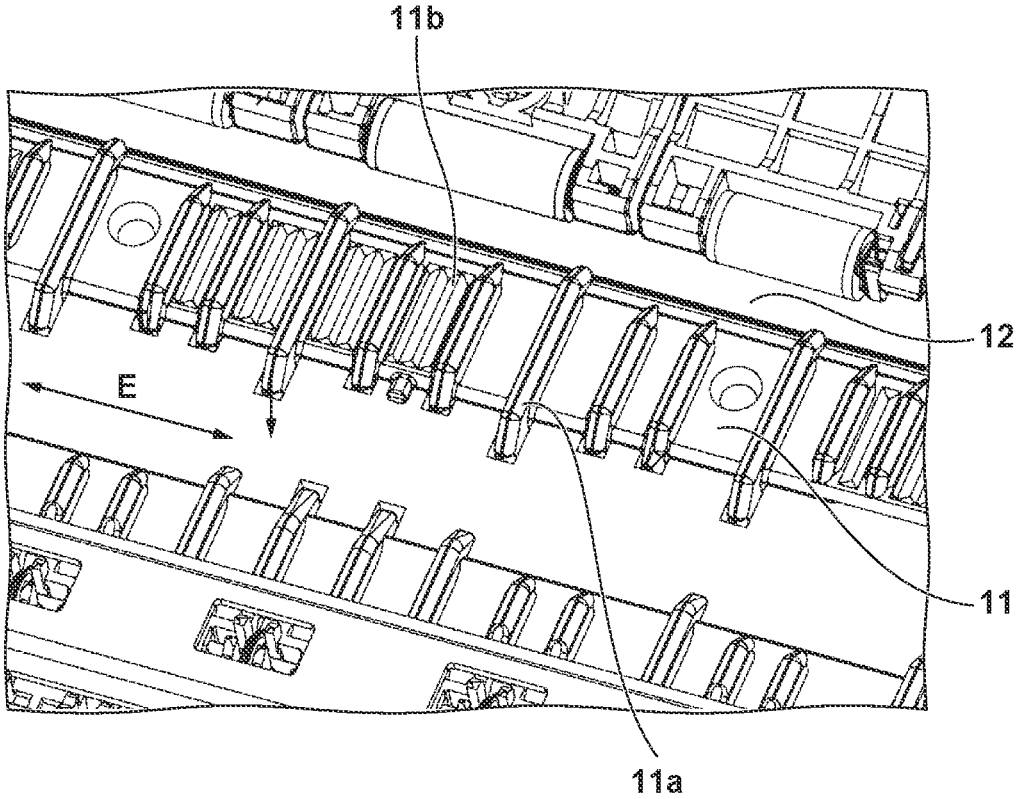
FIG. 5 is a perspective view of the surface of a platen.

FIG. 5 is a perspective view of the surface of the platen 11. On the surface of the platen 11, a plurality of ribs 11*a* are extended in a direction substantially parallel to the conveyance direction. The sheet S is pressed against the ribs 11*a* by the main conveyance roller 12 or the like, and thus conveyed in contact with the ribs 11*a* without moving upward. In this arrangement, the sheet S is appropriately conveyed even if the optical sensor 23 detects the sheet S, and the detection is also appropriately performed. A serrated portion 11*b* is further provided on the surface of the platen 11, and the serrated portion 11*b* includes a slope that obliquely reflects light, thereby reflecting light from above to be diffused to the side. From this viewpoint, the serrated portion 11*b* may be represented as a light scattering portion or the like. As another example, the serrated portion 11*b* may be configured to absorb light, and may be represented as a light absorbing portion.

Note that the serrated portion 11*b* can be provided to be located at substantially the center of the sheet S in the sheet width direction E.

Figure 6:
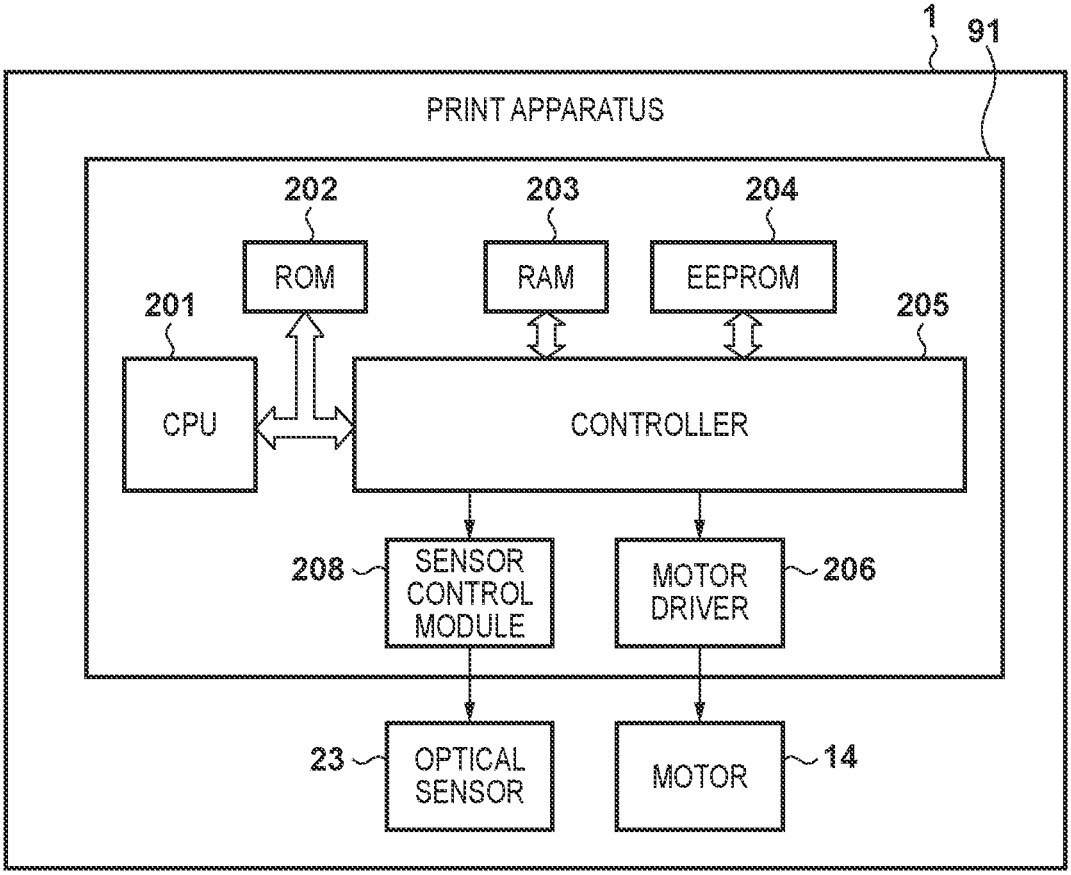
FIG. 6 is a block diagram of a control system of the printing apparatus.

FIG. 6 is a block diagram showing an example of the arrangement of a control system of the printing apparatus 1. The printing apparatus 1 further includes a control unit 91 which controls driving of the overall system of the printing apparatus 1.

The control unit 91 includes a CPU 201, a ROM 202, a RAM 203, an EEROM 204, a controller 205, a motor driver 206, and a sensor control unit 208. The CPU 201 functions as a central processing unit that performs calculation processing. Each of the ROM 202, the RAM 203, and the EEROM 204 functions as a storage unit that stores information.

Based on image information or image data to be printed and the detection result of each sensor, the controller 205 controls, by the motor driver 206, the motor 14 connected to elements that require power, such as the paper feed mechanism 90 and the print unit 3. The controller 205 further controls the optical sensor 23 via the sensor control unit 208 to, for example, set the light emission control amount of the light emitting unit 23*a* and acquire the light receiving output level of the light receiving unit 23*b*.

Note that the light emission control amount is a parameter for deciding or setting the light amount of emitted light of the light emitting unit 23*a*, and if the light emission control amount is set to a large value, the light amount of the emitted light is large. Furthermore, the light receiving output level corresponds to the light amount of the received light of the light receiving unit 23*b*, and has a larger value as the light amount of the received light is larger. The light receiving output level can be said as a detected value of the optical sensor 23.

In the paper feed mechanism 90, when feeding the sheet S to the main conveyance roller 12, the sheet S may be fed in an inclined posture (to be referred to as a "skew" hereinafter). Although details will be described later, this embodiment makes it possible to perform correction (to be referred to as "skew correction" hereinafter) of the skew by deforming the sheet S between the conveyance roller 8 and the main conveyance roller 12 and causing the sheet S to enter the main conveyance roller 12 while making the leading edge of the sheet S abut against the main conveyance roller 12. Thus, the sheet S is conveyed in a suitable posture, and it is possible to appropriately execute printing on the sheet S.

In skew correction, the leading edge of the sheet S is made to abut against the main conveyance roller 12 that is reversely rotated, by conveying the sheet S from the upstream side by the conveyance roller 8 while reversely rotating the main conveyance roller 12 before the leading edge of the sheet S reaches the main conveyance roller 12. Then, when conveyance by the conveyance roller 8 is continued, the sheet S is deformed and guided so that the leading edge of the sheet follows the main conveyance roller 12, thereby performing skew correction.

Note that reverse rotation indicates rotation in a direction, which conveys the sheet S in a direction opposite to the conveyance direction. Furthermore, rotation in a direction, which conveys the sheet S in the conveyance direction, is forward rotation.

Figure 7:
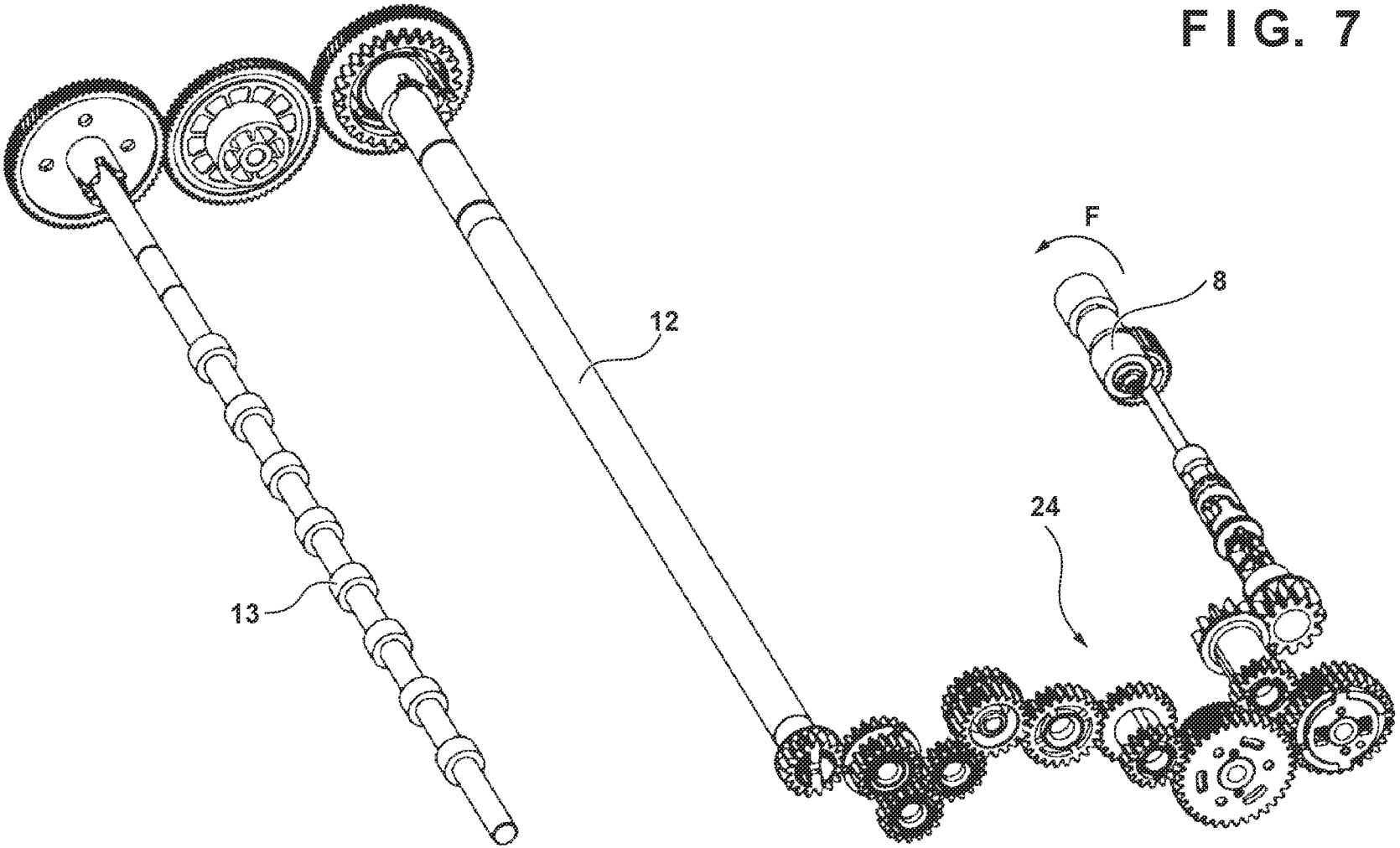
FIG. 7 is a perspective view of a conveyance mechanism.

FIG. 7 is a perspective view of a conveyance mechanism according to this embodiment. Assume that the printing apparatus 1 is configured to drive a plurality of rollers by the single motor 14 for the purpose of reducing cost. The power of the conveyance motor 14 (not shown in FIG. 7) is transmitted to the main conveyance roller 12, and then transmitted to the conveyance roller 8 via a driving transmission unit 24.

In this example, the driving transmission unit 24 is configured so that the conveyance roller 8 rotates in a direction F regardless of the rotation direction of the main conveyance roller 12, thereby making it possible to implement skew correction. On the other hand, in a case where the sheet S is conveyed to the print unit 3, the sheet S is not fed back since the conveyance roller 8 is configured not to perform reverse rotation (configured to perform only forward rotation). Therefore, when detecting the position of the end portion of the sheet S by the optical sensor 23, this detection processing is performed without feeding back the sheet S. Therefore, a complex mechanism is necessarily provided in the printing apparatus 1, thereby making it possible to reduce the cost of the printing apparatus 1.

The arrangement of the printing apparatus 1 is not limited to the above-described example, and changes may be made without departing from the scope so as to have the same functions. For example, a paper feed port for feeding the sheet S is not limited to the paper feed cassette 2 and the rear paper feed port 30, and it can be configured to feed the sheet S from the upper portion of the main body of the printing apparatus 1. A plurality of conveyance motors 14 may be provided. In this case, a structure for transmitting power to the conveyance roller 8 may be formed in another form.

Figure 8:
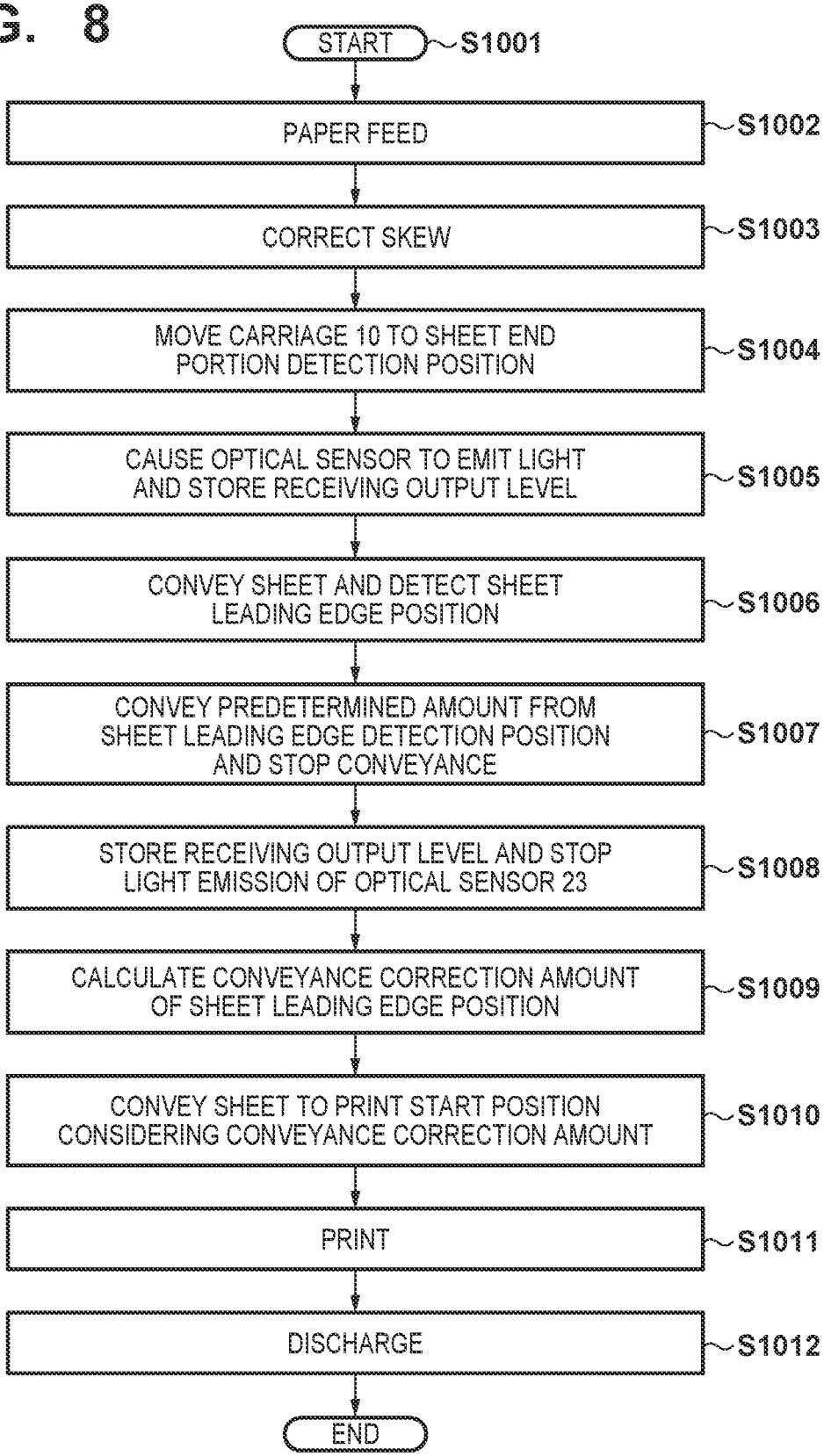
FIG. 8 is a flowchart of a control method of a print operation.

FIG. 8 is a flowchart illustrating an example of a control method of a print operation on the sheet S. This control processing is performed mainly by the control unit 91, and the position of the end portion of the sheet S is detected in this control processing.

In step S1001 (to be simply referred to as "S1001" hereinafter) (the same applies to other steps to be described later), a print operation is started. In S1002, a paper feed operation is executed to feed the sheet S. Note that the print operation indicates a series of operations from when a job for executing printing is received until the printed sheet S is discharged as a printed product.

In S1003, skew correction is performed on the fed sheet S. Thus, the sheet S is guided so that the leading edge of the sheet S follows the main conveyance roller 12. Then, when the leading edge of the sheet S reaches the main conveyance roller 12, a preparation operation for detecting the position of the leading edge of the sheet S is started. Note that at this time, the sheet S has not reached a detection position by the optical sensor 23.

In S1004, the carriage 10 is scanned to move the optical sensor 23 mounted on the carriage 10 to a position where the leading edge of the sheet S is detected. In one embodiment, the optical sensor 23 moves to be located in a central portion of the conveyed sheet S in the sheet width direction. Thus, if skew correction in S1003 is insufficient (a skew amount equal to or larger than a reference amount remains), it is possible to suppress a deviation amount between the detection position of the sheet S by the optical sensor 23 and the actual position of the sheet S. At this time, the optical sensor 23 moves to a position facing the serrated portion 11*b*.

In S1005, the light emitting unit 23*a* of the optical sensor 23 is made to emit light, and the light receiving output level of the light receiving unit 23*b* is stored. In one embodiment, a light emission control amount for making the light emitting unit 23*a* emit light is set based on the evaluation result of the characteristics of the optical sensor 23. This evaluation processing is performed in advance at the time of, for example, manufacturing the printing apparatus 1 or completion of assembly.

In this example, the light receiving output level of the light receiving unit 23*b* may vary due to variations of the characteristics (mainly, the light emission amount of the light emitting unit 23*a* and the light receiving sensitivity of the light receiving unit 23*b*) of the optical sensor 23, a variation of an attachment position to the printing apparatus 1, and the like. Therefore, for example, at the time of manufacturing the printing apparatus 1, calibration of the optical sensor 23 is performed, and the light emission control amount is stored so that the light receiving output level of the light receiving unit 23*b* is constant. Note that when manufacturing two or more printing apparatuses 1, this is performed for each apparatus.

The light emitting unit 23*a* is driven based on the thus set light emission control amount. At this time, since the sheet S has not reached the detection position by the optical sensor 23, the serrated portion 11*b* is irradiated with light from the light emitting unit 23*a*. Since reflected light from the serrated portion 11*b* is diffused to the left and right sides by the surface shape of the serrated portion 11*b*, the reflected light is not directed to the light receiving unit 23*b*. With this arrangement, in a state in which there is no sheet S, the light receiving output level of the light receiving unit 23*b* can have a value indicating that the received light amount is substantially zero.

In S1006, the sheet S is conveyed in a state in which the light emitting unit 23*a* is made to emit light, and the optical sensor 23 detects the position of the end portion of the sheet S. If the sheet S reaches a position below the optical sensor 23, the light from the light emitting unit 23*a* is reflected by the surface of the sheet S toward the light receiving unit 23*b*, thereby changing the light receiving output level of the light receiving unit 23*b*. Then, by monitoring the change of the light receiving output level, the position of the sheet S is stored based on the fact that the changing light receiving output level reaches a threshold level. This threshold level is a threshold or reference value to be compared with the detected value of the optical sensor 23, and is set as a value indicating that the optical sensor 23 has detected the leading edge of the sheet S.

After that, in S1007, the conveyance of the sheet S is stopped at a position where the sheet S is conveyed by a predetermined amount from the stored position. This specifies the conveyance position of the sheet S and sets a state in which the sheet S is surely located at a position below the optical sensor 23.

Since the sheet S changes in light reflection characteristic depending on the type such as a material, color, surface property, and thickness, the actual position of the sheet S may be different from the detection position by the optical sensor 23 at this time. Therefore, in one embodiment, the predetermined amount by which the sheet S is conveyed from the stored position is set large, in consideration of the deviation of the detection position, to the extent that the sheet S is not conveyed to the downstream side of the nozzles of the printhead 22.

Upon completion of the detection of the position of the end portion of the sheet S, the light receiving output level of the light receiving unit 23*b* at this time is stored and then the light emission of the light emitting unit 23*a* is stopped in S1008. The light receiving output level at this time has a value representing the reflected light from the surface of the sheet S since the sheet S is surely located at a position below the optical sensor 23. Furthermore, the light receiving output level at this time does not change due to further conveyance of the sheet S until the trailing edge of the sheet S passes.

In S1009, a correction amount (to be referred to as a conveyance correction amount hereinafter) for correcting the position of the end portion of the sheet S is calculated. Although details will be described later, this calculation processing is performed based on the light receiving output levels before and after the position of the sheet S is detected, that have been stored in S1005 and S1008, the position of the sheet S detected in S1006, and the threshold level at the time of the detection.

Note that a correction amount for correcting the position of the end portion of the sheet S may be calculated only for a sheet having a thickness exceeding a predetermined thickness. That is, execution of S1009 may be suppressed for a sheet having a thickness not exceeding the predetermined thickness. The reason for this is that the difference between the light receiving output level in an ideal state and the actual light receiving output level is small for plain paper. A condition for suppressing execution of S1009 may be decided based on the reflectance of the sheet. In this case, the condition for suppressing execution of S1009 can be set by the user via the operation unit of the printing apparatus. In addition to/instead of this, the type of sheet having a thickness exceeding the predetermined thickness may be preset. In this case, for example, when the user selects a paper type, a correction amount is calculated for thick paper in S1009, and no correction amount is calculated for plain paper.

Figure 9:
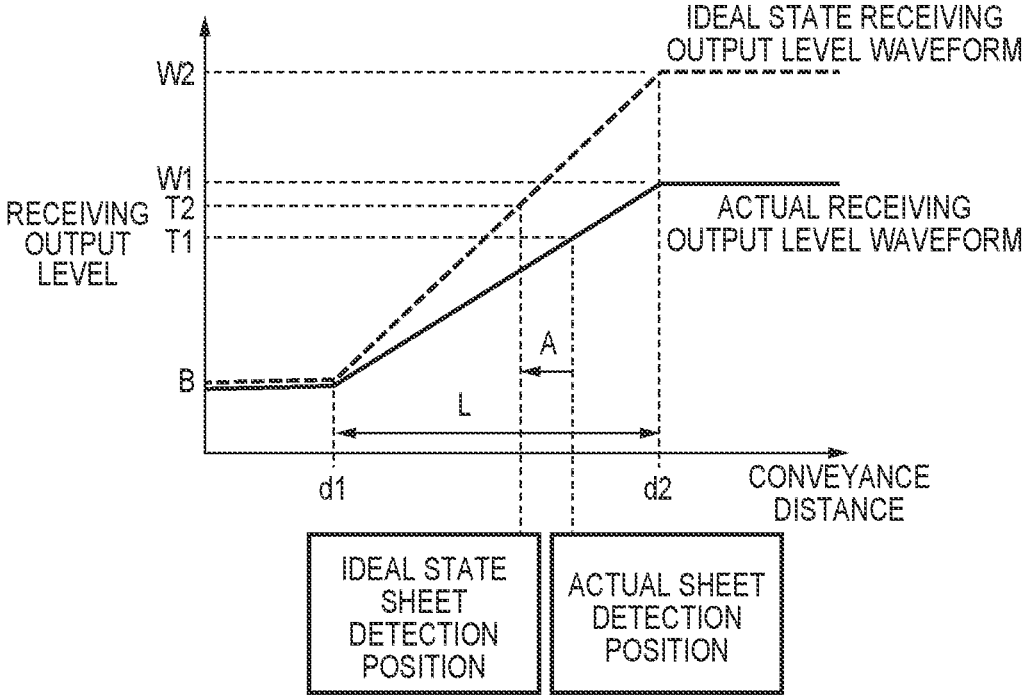
FIG. 9 is a graph of the waveform of a light receiving output level, which shows an example of a method of calculating a conveyance correction amount.

A method of calculating the conveyance correction amount in a case where the light receiving output level when detecting the position of the end portion of the sheet S is approximated to linearly change will be described with reference to FIG. 9. In FIG. 9, the abscissa represents the conveyance distance (or conveyance position) of the sheet S. The ordinate represents the light receiving output level of the light receiving unit 23*b*, and the light receiving output level indicates that as the value is larger, the received light amount of the light receiving unit 23*b* is larger. Note that the light receiving output level is actually acquired as a voltage value by the sensor control unit 208 shown in FIG. 6.

In FIG. 9, the light receiving output level (the light receiving output level before the conveyance position of the sheet S is detected) stored in S1005 is represented by B. The light receiving output level (the light receiving output level after the conveyance position of the sheet S is detected) stored in S1008 is represented by W1. A threshold level when the sheet S is detected in S1006 is represented by T1.

A deviation amount between the position of the sheet S detected in S1006 and the position (ideal value) of the sheet S to be ideally detected is represented by A. The light receiving output level when calibration of the optical sensor 23 is ideally executed is represented by W2, and a threshold level set in this case is represented by T2. Furthermore, the width, on the abscissa, of a region where the light receiving output level changes is represented by L. At this time, the deviation amount A is given by:

$$A=((T2-B)/(W2-B)-(T1-B)/(W1-B))\times L \quad (1)$$

Referring to FIG. 9, as the conveyance distance represented by the abscissa is larger (on the right side of the graph), the sheet S is conveyed to the downstream side in the conveyance direction, and a region where the conveyance distance is smaller than d1 corresponds to a state in which the sheet S does not reach a position below the optical sensor 23. Therefore, the light receiving output level at this time is low. If the conveyance distance becomes equal to or larger than d1, the sheet S partially reaches a light irradiation region of the light emitting unit 23*a* (or the sheet S starts to enter the light irradiation region), and thus the light receiving output level changes to increase.

Then, if the conveyance distance becomes equal to or larger than d2, the sheet S reaches the substantially entire light irradiation region of the light emitting unit 23*a*, and thus the light receiving output level is substantially constant. Since the light receiving output level does not change due to further conveyance of the sheet S until the trailing edge of the sheet S passes, the sheet S includes or overlaps substantially the entire light irradiation region.

Since the light receiving output level W1 (the light receiving output level after the conveyance position of the sheet S is detected) stored in S1008 can change depending on the characteristics of the sheet S to be conveyed, as described above, it is difficult to predict the value in advance. To cope with this, this embodiment assumes a case where the light receiving output level has an ideal value, and a mode of the change is indicated by a broken line (to be referred to as an expected waveform in the following description) in FIG. 9. If the sheet S does not exist in the light irradiation region of the light emitting unit 23*a*, the light is diffused by the serrated portion 11*b* of the platen 11. Therefore, the above-described expected waveform can be created by assuming that even if the light amount of the light emitting unit 23*a* changes, the light receiving output level remains unchanged from the light receiving output level B (the light receiving output level before the conveyance position of the sheet S is detected) stored in S1005. Alternatively, the above-described expected waveform can be created so that the light receiving output level linearly changes between the conveyance distances d1 and d2 by assuming that even if the light amount of the light emitting unit 23*a* changes, the distance L (that is, the region L where the light receiving output level changes) remains unchanged.

Based on the thus created expected waveform, the ideal value of the detection position of the sheet S can be obtained using the threshold level T2 set when ideally detecting the position of the end portion of the sheet S. On the other hand, since the actual light receiving output level W1 is difficult to be predicted because it varies depending on the characteristics of the sheet S, the position of the sheet S detected using the threshold level T1 when actually detecting the sheet S deviates from the ideal detection position by the deviation amount A. By calculating the deviation amount A based on equation (1) above, the conveyance correction amount from the actual detection position of the sheet S to the ideal detection position can be calculated. Note that the threshold levels T1 and T2 may be equal to each other.

Referring back to FIG. 8, in S1010, the sheet S is conveyed to the print start position based on the conveyance correction amount calculated in S1009. This completes the detection of the position of the end portion of the sheet S by the optical sensor 23 and the conveyance of the sheet S based on the result of the detection. After that, printing is executed on the sheet S in S1011, and the sheet S is discharged in S1012, thereby completing the print operation.

The mode in which the conveyance correction amount is calculated based on equation (1) above by assuming that the light receiving output level linearly changes has been exemplified above. However, the actual change of the light receiving output level can represent a nonlinear waveform. Therefore, an error can be generated in the conveyance correction amount by calculation based on equation (1). This error can be suppressed by adjusting the region L where the light receiving output level changes. As an example, the region L is set smaller than a region where the light receiving output level actually changes. For example, the light receiving output level gradually changes at the start or end of the change. Therefore, the region L is set in accordance with the gradually changing region based on, for example, only the region where the light receiving output level actually linearly changes.

Figure 10:
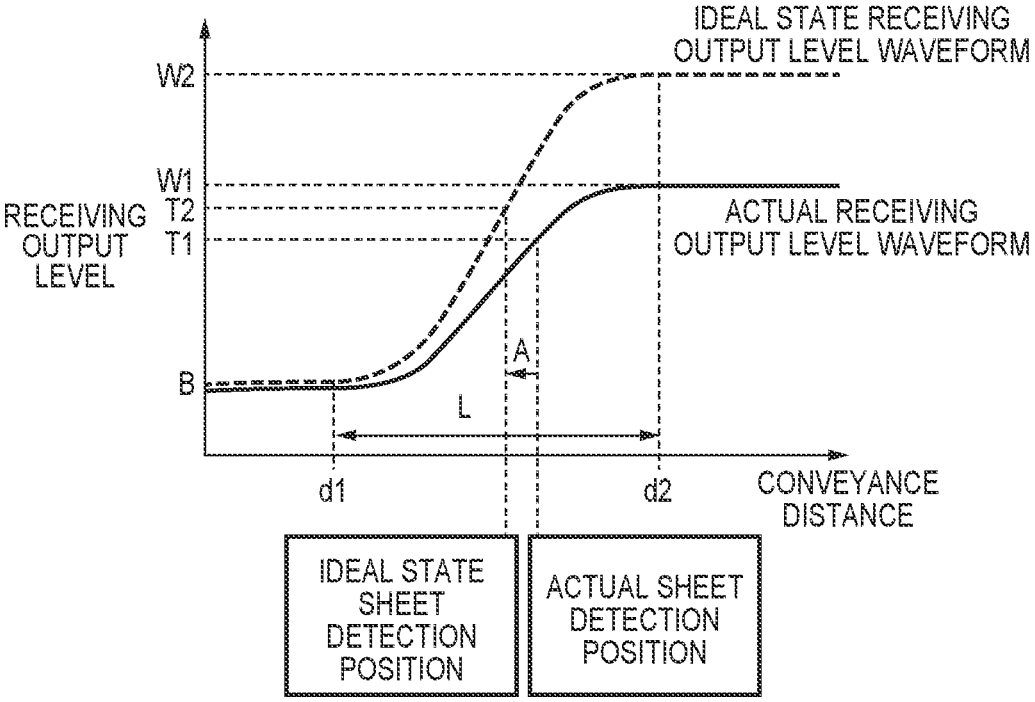
FIG. 10 is a graph of the waveform of a light receiving output level, which shows another example of the method of calculating the conveyance correction amount.

As another method of calculating the conveyance correction amount, a case where the light receiving output level when detecting the position of the end portion of the sheet S is approximated to nonlinearly change will be described with reference to FIG. 10. In this case, an ideal nonlinear waveform is stored in advance, and the actual light receiving output level and the light receiving output level in the ideal state can be created using the light receiving output levels before and after the position of the sheet S is detected, which have been obtained in the same procedure as in the flowchart of FIG. 8. At this time, while the light receiving output level B and the region L are the same as in the example shown in FIG. 9, it is assumed that the ratio between the actual light receiving output level and the light receiving output level in the ideal state is constant, thereby making it possible to create both the waveforms of the light receiving output levels. By calculating the deviation amount A using the threshold levels T1 and T2 based on the thus created waveforms, it is possible to calculate the conveyance correction amount even in a case where the light receiving output level nonlinearly changes.

In this way, by performing comparison with the ideal light receiving output level, the conveyance correction amount can be calculated based on the light receiving output levels before and after the position of the sheet S is detected, the actually detected position of the sheet S, and the threshold level at the time of the detection. In this example, by using the calculated conveyance correction amount, it is possible to accurately detect the position of the end portion of the sheet S without feeding back the sheet S.

As another embodiment, it is possible to more surely detect the end portion of the sheet S by additionally/alternatively executing control for preventing erroneous detection by the optical sensor 23. For example, when detecting the position of the end portion of the sheet S in S1006 (see FIG. 8), the light receiving output level of the light receiving unit 23*b* unexpectedly exceeds the threshold level, and the position of the end portion of the sheet S may erroneously be detected at this time. Examples of the cause of the erroneous detection are erroneous detection caused by external light entering from a gap with an accessory, and error detection caused by installation of another element at a position facing the optical sensor 23 or near the optical sensor 23. To avoid these cases, in a case where the light receiving output level stored in S1005 exceeds a predetermined level, detection along with this may be determined as erroneous detection, and the detection may be interrupted or stopped. This can confirm that the light receiving output level in a state in which the sheet S is not located at a position below the optical sensor 23 is normal, and prevent erroneous detection, thereby appropriately implementing detection of the position of the end portion of the sheet S.

In a case where the position of the end portion of the sheet S is not detected even if the sheet S is conveyed over a long distance in S1006, the sheet S is discharged as erroneous detection but calibration of the optical sensor 23 may be executed during this period. As an example, there is a case where the reflected light is weakened more than a reference due to the characteristics of the sheet S to be conveyed, and the light receiving output level does not reach the threshold level. In this case, the reflected light may be intensified by changing or adjusting the light emission control amount of the light emitting unit 23*a* to intensify emitted light, thereby making it possible to detect the sheet S. Therefore, a new light emission control amount is set by performing calibration while the sheet S is discharged, and is used to detect the sheet S when setting the discharged sheet S again at the paper feed port and feeding it again. Note that this calibration is performed at a timing when the edge sensor 9 provided in the paper feed mechanism 90 detects the trailing edge of the sheet S and the sheet S is surely located at a position below the optical sensor 23.

This embodiment has exemplified the mode in which the conveyance of the sheet S is stopped in S1007, the conveyance correction amount is calculated in S1009, and the conveyance of the sheet S is resumed in S1010. However, the present invention is not limited to this control mode. For example, after the position of the end portion of the sheet S is detected in S1006, the light receiving output level may be acquired without stopping the conveyance of the sheet S in a state in which the sheet S is located at a position below the optical sensor 23, and the conveyance correction amount may then be calculated. In this mode as well, a target position to which the sheet S is conveyed can be set. In this case, during the conveyance of the sheet S from a position where the light receiving output level is acquired to a position where printing is started, it is necessary to complete the calculation of the conveyance correction amount and the change of the target position of the conveyance of the sheet S. On the other hand, since the time taken to stop the conveyance and resume the conveyance is unnecessary, it is possible to shorten the necessary time of the print operation.

In this embodiment, as described with reference to FIG. 2, it is also possible to execute printing on the relatively thick sheet S from the rear paper feed port 30. In the case of the thick sheet S, the sheet S cannot appropriately enter the main conveyance roller 12 unless the conveyance roller 8 assists conveyance power from the upstream side in the conveyance direction. Then, if the timing of assisting the conveyance power by the conveyance roller 8 varies, the timing at which the sheet S enters the main conveyance roller 12 may vary. Therefore, in the case of the thick sheet S, after the sheet S enters the main conveyance roller 12, it may be necessary to detect the position of the sheet S. According to this embodiment, by detecting the position of the end portion of the sheet S by the optical sensor 23 on the downstream side of the main conveyance roller 12, it is possible to start printing at a suitable position of the sheet S. That is, according to this embodiment, it is possible to appropriately implement printing on various types of print media including the relatively thick sheet S by a relatively simple arrangement.

As described above, according to this embodiment, the optical sensor 23 detects the sheet S on the upstream side of the printhead 22 or the nozzles 22*a*, and the conveyance correction amount is calculated based on the detection result. First, the light receiving output level B is acquired as a value before the detected value of the optical sensor 23 changes (that is, before the sheet S reaches the light irradiation region of the light emitting unit 23*a*). Furthermore, the light receiving output level W1 is acquired as a value after the detected value of the optical sensor 23 changes (that is, after the sheet S includes the light irradiation region of the light emitting unit 23*a*). At this time, the threshold level T1 is set as a threshold or reference value to be compared with the detected value of the optical sensor 23. The threshold level T1 can be set as a value indicating that the optical sensor 23 has detected the leading edge of the sheet S. Then, the deviation amount A from the ideal waveform of the light receiving output level is calculated based on the conveyance distance L (the conveyance distance while the light receiving output level changes from B to W1) while the light receiving output level changes and the conveyance distance when the light receiving output level reaches the threshold level T1 during that period.

The ideal waveform used to calculate the deviation amount A can be created with reference to the conveyance distance L based on the above-described light receiving output level B and the ideal value W2 of the light receiving output level based on the light receiving output level B. The deviation amount A can be calculated by the difference between the conveyance distance corresponding to the threshold level T2 in the thus created ideal waveform and the conveyance distance when the light receiving output level reaches the threshold level T1. As the conveyance correction amount, the deviation amount A may directly be applied or a value calculated by additionally using a predetermined correction factor may be applied.

According to this embodiment, by correcting the conveyance amount of the sheet S using the thus obtained conveyance correction amount, it is possible to correct the detection position of the sheet S, thereby improving the accuracy of the conveyance of the sheet S. Along with this, it is possible to start printing by the printhead 22 at a suitable position of the sheet S, which is advantageous in, for example, improvement of the quality of a printed product.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the above description, the printing apparatus 1 using the inkjet printing method has been described as an example. However, the printing method is not limited to this. Furthermore, the printing apparatus 1 may be a single function printer having only a printing function or may be a multi-function printer having a plurality of functions such as a printing function, a FAX function, and a scanner function. In addition, the printing apparatus 1 may be a manufacturing apparatus configured to manufacture, for example, a color filter, an electronic device, an optical device, a microstructure, or the like by a predetermined printing method.

Furthermore, "print" in this specification should be interpreted in a broader sense. Hence, the mode of "print" is irrespective of whether or not the target to be formed on a print medium is significant information such as a character or graphic pattern, and is also irrespective of whether the target is manifested in a way that can be perceived visually by humans.

"Print medium" should also be interpreted in a broader sense, like "print". Hence, the concept of "print medium" can include not only paper used in general but also any materials capable of receiving ink, including fabrics, plastic films, metals, metal plates, glass, ceramics, resins, wood, and leathers.

"Ink" should also be interpreted in a broader sense, like "print". Hence, the concept of "ink" can include not only a liquid that is applied to a print medium to form an image, a design, a pattern, or the like but also an incidental liquid that can be provided to process a print medium or process ink (for example, coagulate or insolubilize color materials in ink applied to a print medium).

In the embodiments, individual elements are named by expressions based on their main functions. However, the functions described in the embodiments may be sub-functions, and the expressions are not strictly limited. Furthermore, the expressions can be replaced with similar expressions. In the same vein, an expression "unit (portion)" can be replaced with an expression "tool", "component", "member", "structure", "assembly", or the like. Alternatively, these may be omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-152805, filed on Sep. 26, 2022, which is hereby incorporated by reference herein in its entirety.

What is claimed is:

1. A printing apparatus comprising:

a conveyance roller configured to convey a print medium;

a print unit configured to execute printing on the print medium;

a platen arranged to face the print unit and configured to support the print medium;

a sensor configured to emit light to the platen and detect light from the platen;

a control unit configured to execute first control of acquiring, as a first value, a detected value before the print medium reaches a light irradiation region of the sensor, and acquiring, as a second value, a detected value after the print medium is conveyed to include the light irradiation region;

wherein the control unit further executes second control of correcting a conveyance amount of the print medium by the conveyance roller based on the first value and the second value; and further comprising a calculation unit configured to calculate a correction amount for correcting the conveyance amount, wherein the control unit further acquires a conveyance distance of the print medium from a start to an end of a change of the detected value of the sensor, and a conveyance distance of the print medium when the changing detected value reaches a threshold, and the calculation unit calculates the correction amount further based on the acquired conveyance distances.

2. The apparatus according to claim 1, wherein the calculation unit calculates an ideal waveform of the change of the detected value of the sensor based on the acquired conveyance distances, and calculates the correction amount based on a deviation amount between the ideal waveform and a waveform calculated based on the acquired conveyance distances, the first value, and the second value.

3. The apparatus according to claim 2, wherein the calculation unit calculates the correction amount in a case where the print medium has a thickness larger than a predetermined thickness, and suppresses calculation of the correction amount in a case where the print medium has a thickness not larger than the predetermined thickness.

4. The apparatus according to claim 1, wherein the sensor is configured so that a light amount of reflected light from the print medium is larger than a light amount of reflected light from the platen.

5. The apparatus according to claim 4, further comprising a light scattering portion or a light absorbing portion at a position facing the sensor.

6. The apparatus according to claim 1, wherein the print unit includes a printhead, and a carriage configured to support and scan the printhead, and the sensor is installed in the carriage to be located on an upstream side of the printhead.

7. The apparatus according to claim 6, wherein in the first control, the control unit causes the carriage to locate the sensor in a central portion of the print medium in a width direction, and then acquires the first value and the second value.

8. The apparatus according to claim 1, further comprising, as the conveyance roller, a first conveyance roller pair configured to convey the print medium and located on an upstream side of the sensor, and a second conveyance roller pair configured to convey the print medium and located on an upstream side of the first conveyance roller pair, wherein the control unit further executes guiding the print medium to correct a skew of the print medium, and before the sensor detects the print medium, the control unit corrects the skew by making a leading edge of the print medium abut against the first conveyance roller pair while conveying the print medium by the second conveyance roller pair.

9. The apparatus according to claim 8, wherein, in a case of guiding the print medium, the control unit reversely rotates the first conveyance roller pair to make the leading edge of the print medium abut against the first conveyance roller pair.

10. The apparatus according to claim 1, further comprising a paper feed port configured to feed the print medium, wherein a conveyance path of the print medium from the paper feed port to the print unit is extended in one direction on a side view so that a curvature is not larger than a reference value.

11. The apparatus according to claim 1, wherein the calculation unit calculates the distance, as a first distance, based on the conveyance amount and a first threshold before the sensor is calibrated, and the calculation unit calculates the distance, as a second distance, based on the conveyance amount and a second threshold after the sensor is calibrated.

12. A conveyance method of a print medium in a printing apparatus including a conveyance roller configured to convey the print medium, a print unit configured to execute printing on the print medium, a platen arranged to face the print unit and configured to support the print medium, and a sensor configured to emit light to the platen and detect light from the platen, the method comprising:

acquiring, as a first value, a detected value before the print medium reaches a light irradiation region of the sensor;

acquiring, as a second value, a detected value after the print medium is conveyed to include the light irradiation region;

correcting a conveyance amount of the print medium by the conveyance roller based on the first value and the second value; and further comprising calculating a correction amount for correcting the conveyance amount, wherein in the acquiring, a conveyance distance of the print medium from a start to an end of a change of the detected value of the sensor and a conveyance distance of the print medium when the changing detected value reaches a threshold are further acquired, and in the calculating, the correction amount is calculated further based on the acquired conveyance distances.

13. The method according to claim 12, wherein in the calculating, an ideal waveform of the change of the detected value of the sensor is calculated based on the acquired conveyance distances, and the correction amount is calculated based on a deviation amount between the ideal waveform and a waveform calculated based on the acquired conveyance distances, the first value, and the second value.

14. The method according to claim 12, wherein in the calculating, the correction amount is calculated in a case where the print medium has a thickness larger than a predetermined thickness, and calculation of the correction amount is suppressed in a case where the print medium has a thickness not larger than the predetermined thickness.

15. The method according to claim 12, wherein the print unit includes a printhead, and a carriage configured to support and scan the printhead, the sensor is installed in the carriage to be located on an upstream side of the printhead, and in the acquiring, the carriage locates the sensor in a central portion of the print medium in a width direction, and then the first value and the second value are acquired.

16. The method according to claim 12, wherein the printing apparatus further comprises, as the conveyance roller, a first conveyance roller pair configured to convey the print medium and located on an upstream side of the sensor, and a second conveyance roller pair configured to convey the print medium and located on an upstream side of the first conveyance roller pair, the conveyance method further comprises guiding the print medium to correct a skew of the print medium, and in the guiding, before the sensor detects the print medium, the skew is corrected by making a leading edge of the print medium abut against the first conveyance roller pair while conveying the print medium by the second conveyance roller pair.

17. The method according to claim 16, wherein in the guiding, the first conveyance roller pair is reversely rotated to make the leading edge of the print medium abut against the first conveyance roller pair.

18. The method according to claim 12, wherein the printing apparatus further comprises a paper feed port configured to feed the print medium, and a conveyance path of the print medium from the paper feed port to the print unit is extended in one direction on a side view so that a curvature is not larger than a reference value.

* * * * *